US008237363B2

(12) United States Patent
Mizokami et al.

(10) Patent No.: US 8,237,363 B2
(45) Date of Patent: Aug. 7, 2012

(54) PLASMA DISPLAY PANEL WITH MGO CRYSTAL PROTECTIVE LAYER

(75) Inventors: Kaname Mizokami, Kyoto (JP); Shinichiro Ishino, Osaka (JP); Koyo Sakamoto, Osaka (JP); Akira Shiokawa, Osaka (JP); Hiroyuki Kadou, Osaka (JP); Yoshinao Ooe, Kyoto (JP); Hideji Kawarazaki, Osaka (JP); Kazuo Uetani, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/530,844

(22) PCT Filed: Nov. 12, 2008

(86) PCT No.: PCT/JP2008/003279

§ 371 (c)(1),
(2), (4) Date: Sep. 11, 2009

(87) PCT Pub. No.: WO2009/066425

PCT Pub. Date: May 28, 2009

(65) Prior Publication Data

US 2010/0102722 A1 Apr. 29, 2010

(30) Foreign Application Priority Data

Nov. 21, 2007 (JP) ..... 2007-301493

(51) Int. Cl.
*H01J 17/49* (2012.01)

(52) U.S. Cl. ..... 313/587; 313/581; 313/582; 313/586; 445/24; 445/25

(58) Field of Classification Search ..... 313/581–587; 345/60, 30, 37; 445/24–25; 315/169.4
See application file for complete search history.

(56) References Cited

U.S. PATENT DOCUMENTS 6,753,649 B1 6/2004 Bechtel et al.
7,759,868 B2 7/2010 Naoi et al.
(Continued)

FOREIGN PATENT DOCUMENTS

EP 1 657 735 5/2006
(Continued)

OTHER PUBLICATIONS

Supplementary European Search Report issued Oct. 8, 2009 in Application No. EP 08 85 2955.

(Continued)

*Primary Examiner* — Tracie Y Green
(74) *Attorney, Agent, or Firm* — Wenderoth Lind & Ponack, L.L.P.

(57) ABSTRACT

A plasma display panel includes a front panel including a substrate, a display electrode formed on the substrate, a dielectric layer formed so as to cover the display electrode, and a protective layer formed on the dielectric layer; and a rear panel disposed facing the front panel so that discharge space is formed, and including an address electrode formed in a direction intersecting the display electrode and a barrier rib for partitioning the discharge space. The protective layer is formed by forming a base film on the dielectric layer and attaching a plurality of aggregated particles of a plurality of crystal particles of metal oxide to the base film so that a plurality of aggregated particles are distributed over the entire surface, and the base film is made of MgO containing Al.

5 Claims, 5 Drawing Sheets

U.S. PATENT DOCUMENTS

| | | | | |
|---|---|---|---|---|
| 7,994,718 | B2 * | 8/2011 | Mizokami et al. | 313/582 |
| 2004/0070341 | A1 * | 4/2004 | Chul Park | 313/582 |
| 2006/0012721 | A1 * | 1/2006 | Morita et al. | 348/739 |
| 2006/0284559 | A1 | 12/2006 | Naoi et al. | |
| 2007/0080641 | A1 * | 4/2007 | Yamamoto | 313/586 |
| 2007/0096653 | A1 * | 5/2007 | Jeong et al. | 313/586 |
| 2007/0210712 | A1 * | 9/2007 | Miyata et al. | 313/587 |
| 2007/0228980 | A1 * | 10/2007 | Miyata et al. | 313/587 |
| 2008/0224613 | A1 * | 9/2008 | Yoo et al. | 313/587 |
| 2009/0167176 | A1 | 7/2009 | Fukui et al. | |
| 2010/0060163 | A1 * | 3/2010 | Mizokami et al. | 313/582 |
| 2010/0102723 | A1 * | 4/2010 | Mizokami et al. | 313/587 |
| 2010/0109524 | A1 * | 5/2010 | Mizokami et al. | 313/582 |
| 2010/0127622 | A1 * | 5/2010 | Ooe et al. | 313/582 |
| 2010/0213818 | A1 | 8/2010 | Naoi et al. | |

FOREIGN PATENT DOCUMENTS

| | | |
|---|---|---|
| JP | 2001-118511 | 4/2001 |
| JP | 2003-128430 | 5/2003 |
| JP | 2006-244784 | 9/2006 |
| JP | 2007-35655 | 2/2007 |
| JP | 2007-48733 | 2/2007 |
| JP | 2007-206499 | 8/2007 |
| JP | 2007-233320 | 9/2007 |
| JP | 2008-293803 | 12/2008 |
| KR | 2006-0056869 | 5/2006 |
| WO | 2007/088801 | 8/2007 |
| WO | 2007/126061 | 11/2007 |

OTHER PUBLICATIONS

European Office Action issued Jun. 10, 2010 in Application No. 08 852 955.7.

"SPI Supplies Brand MgO Magnesium Oxide Single Crystal Substrates, Blocks, and Optical Components", from the web page of www.2spi.com.

International Search Report issued Dec. 22, 2008 in International (PCT) Application No. PCT/JP2008/003279.

* cited by examiner

PLASMA DISPLAY PANEL WITH MGO CRYSTAL PROTECTIVE LAYER

This application is a U.S. National Phase Application of PCT International Application PCT/JP2008/003279.

BACKGROUND OF THE INVENTION

TECHNICAL FIELD

The present invention relates to a plasma display panel used in a display device, and the like.

BACKGROUND ART

Since a plasma display panel (hereinafter, referred to as a "PDP") can realize a high definition and a large screen, 65-inch class televisions are commercialized. Recently, PDPs have been applied to high-definition television in which the number of scan lines is twice or more than that of a conventional NTSC method. Meanwhile, from the viewpoint of environmental problems, PDPs without containing a lead component have been demanded.

A PDP basically includes a front panel and a rear panel. The front panel includes a glass substrate of sodium borosilicate glass produced by a float process; display electrodes each composed of striped transparent electrode and bus electrode formed on one principal surface of the glass substrate; a dielectric layer covering the display electrodes and functioning as a capacitor; and a protective layer made of magnesium oxide (MgO) formed on the dielectric layer. On the other hand, the rear panel includes a glass substrate; striped address electrodes formed on one principal surface of the glass substrate; a base dielectric layer covering the address electrodes; barrier ribs formed on the base dielectric layer; and phosphor layers formed between the barrier ribs and emitting red, green and blue light, respectively.

The front panel and the rear panel are hermetically sealed so that the surfaces having electrodes face each other. Discharge gas of Ne—Xe is filled in discharge space partitioned by the barrier ribs at a pressure of 400 Torr to 600 Torr. The PDP realizes a color image display by selectively applying a video signal voltage to the display electrode so as to generate electric discharge, thus exciting a phosphor layer of each color with ultraviolet ray generated by the electric discharge so as to emit red, green and blue light (see patent document 1).

In such PDPs, the role of the protective layer formed on the dielectric layer of the front panel includes protecting the dielectric layer from ion bombardment by discharge, emitting initial electrons so as to generate address discharge, and the like. Protecting the dielectric layer from ion bombardment is an important role for preventing a discharge voltage from increasing. Emitting initial electrons so as to generate address discharge is an important role for preventing address discharge error that may cause flicker of an image.

In order to reduce flicker of an image by increasing the number of initial electrons from the protective layer, an attempt to add Si and Al into MgO has been made for instance.

Recently, televisions have realized higher definition. In the market, low cost, low power consumption and high brightness full HD (high definition) (1920×1080 pixels: progressive display) PDPs have been demanded. Since an electron emission property from a protective layer determines an image quality of a PDP, it is very important to control the electron emission property.

In PDPs, an attempt to improve the electron emission property has been made by mixing impurities in a protective layer.

However, when the electron emission property is improved by mixing impurities in the protective layer, electric charges are accumulated on the surface of the protective layer, thus increasing a damping factor, that is, reducing electric charge to be used as a memory function over time. Therefore, in order to suppress this, it is necessary to take measures, for example, to increase a voltage to be applied. Thus, a protective layer should have two conflicting properties, a high electron emission property and a high electric charge maintaining property that is a property of reducing a damping factor of electric charge as a memory function.

[Patent document 1] Japanese Patent Unexamined Publication No. 2003-128430

SUMMARY OF THE INVENTION

A PDP of the present invention includes a front panel including a substrate, a display electrode formed on the substrate, a dielectric layer formed so as to cover the display electrode, and a protective layer formed on the dielectric layer; and a rear panel disposed facing the front panel so that discharge space is formed and including an address electrode formed in a direction intersecting the display electrode, and a barrier rib for partitioning the discharge space. The protective layer is formed by forming a base film on the dielectric layer and attaching a plurality of aggregated particles of a plurality of crystal particles of metal oxide to the base film so that the aggregated particles are distributed over its entire surface, and the base film is made of MgO containing Al.

With such a configuration, a PDP having an improved electron emission property and an electric charge retention property, and capable of achieving high image quality, low cost, and low voltage can be provided. Thus, a PDP with low electric power consumption and high-definition and high-brightness display performance can be realized.

REFERENCE MARKS IN THE DRAWINGS

Figure 1:
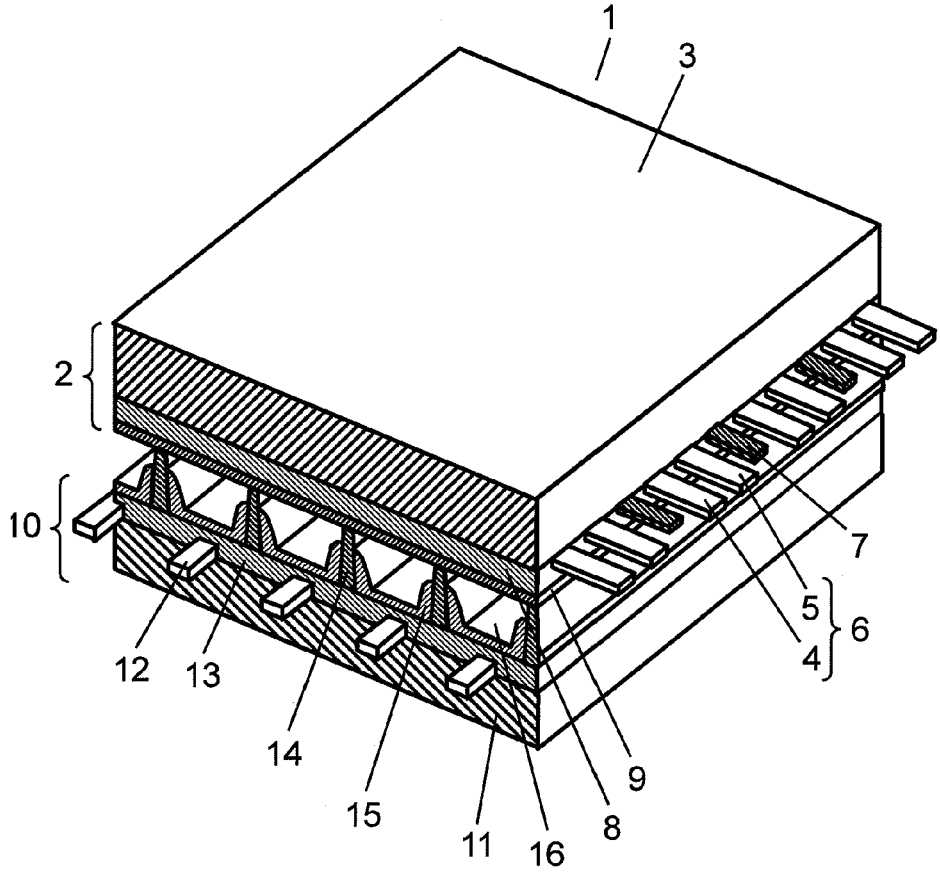
FIG. 1 is a perspective view showing a structure of a PDP in accordance with an exemplary embodiment of the present invention.

1 PDP
2 front panel

3 front glass substrate
4 scan electrode
4*a*, 5*a* transparent electrode
4*b*, 5*b* metal bus electrode
5 sustain electrode
6 display electrode
7 black stripe (light blocking layer)
8 dielectric layer
9 protective layer
10 rear panel
11 rear glass substrate
12 address electrode
13 base dielectric layer
14 barrier rib
15 phosphor layer
16 discharge space
81 first dielectric layer
82 second dielectric layer
91 base film
92 aggregated particles
92*a* crystal particle

DETAILED DESCRIPTION OF THE INVENTION

Hereinafter, a PDP in accordance with an exemplary embodiment of the present invention is described with reference to drawings.

(Exemplary Embodiment)

FIG. 1 is a perspective view showing a structure of a PDP in accordance with the exemplary embodiment of the present invention. The basic structure of the PDP is the same as that of a general AC surface-discharge type PDP. As shown in FIG. 1, PDP 1 includes front panel 2 including front glass substrate 3, and the like, and rear panel 10 including rear glass substrate 11, and the like. Front panel 2 and rear panel 10 are disposed facing each other and hermetically sealed together at the peripheries thereof with a sealing material made of a glass frit, and the like. In discharge space 16 inside the sealed PDP 1, discharge gas such as Ne and Xe is filled in at a pressure of 400 Torr to 600 Torr.

On front glass substrate 3 of front panel 2, plurality of band-like display electrodes 6 each composed of a pair of scan electrode 4 and sustain electrode 5 and black stripes (light blocking layers) 7 are disposed in parallel to each other. On glass substrate 3, dielectric layer 8 functioning as a capacitor is formed so as to cover display electrodes 6 and blocking layers 7. Furthermore, on the surface of dielectric layer 8, protective layer 9 made of, for example, magnesium oxide (MgO) is formed.

Furthermore, on rear glass substrate 11 of rear panel 10, a plurality of band-like address electrodes 12 are disposed in parallel to each other in the direction orthogonal to scan electrodes 4 and sustain electrodes 5 of front panel 2, and base dielectric layer 13 covers address electrodes 12. In addition, barrier ribs 14 with a predetermined height for partitioning discharge space 16 are formed between address electrodes 12 on base dielectric layer 13. In grooves between barrier ribs 14, every address electrode 12, phosphor layers 15 emitting red, green and blue light by ultraviolet ray are sequentially formed by coating. Discharge cells are formed in positions in which scan electrodes 4 and sustain electrodes 5 and address electrodes 12 intersect each other. The discharge cells having red, green and blue phosphor layers 15 arranged in the direction of display electrode 6 function as pixels for color display.

Figure 2:
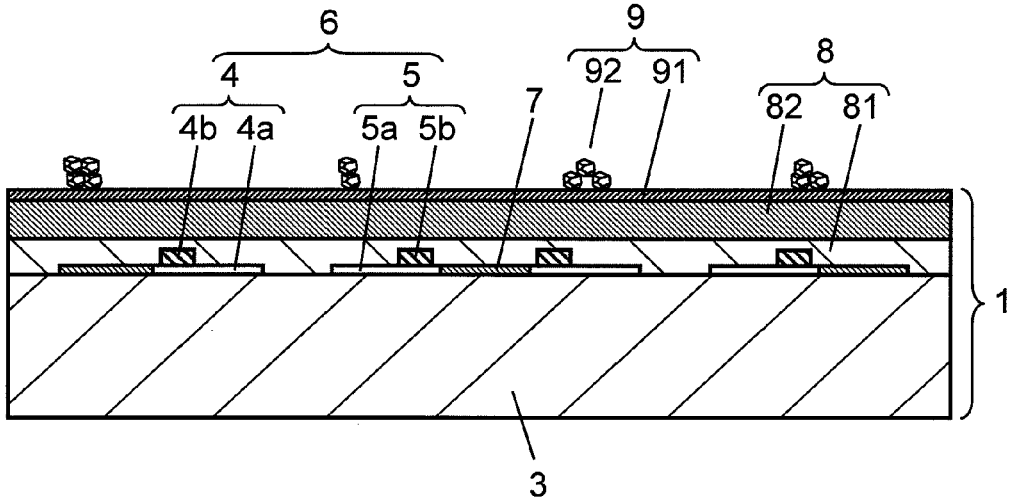
FIG. 2 is a sectional view showing a configuration of a front panel of the PDP.

FIG. 2 is a sectional view showing a configuration of front panel 2 of PDP 1 in accordance with an exemplary embodiment of the present invention. FIG. 2 is shown turned upside down with respect to FIG. 1. As shown in FIG. 2, display electrodes 6 each composed of scan electrode 4 and sustain electrode 5 and light blocking layers 7 are pattern-formed on front glass substrate 3 produced by, for example, a float method. Scan electrode 4 and sustain electrode 5 include transparent electrodes 4*a* and 5*a* made of indium tin oxide (ITO), tin oxide ($SnO_2$), or the like, and metal bus electrodes 4*b* and 5*b* formed on transparent electrodes 4*a* and 5*a*, respectively. Metal bus electrodes 4*b* and 5*b* are used for the purpose of providing the conductivity in the longitudinal direction of transparent electrodes 4*a* and 5*a* and formed of a conductive material containing a silver (Ag) material as a main component.

Dielectric layer 8 includes at least two layers, that is, first dielectric layer 81 and second dielectric layer 82. First dielectric layer 81 is provided for covering transparent electrodes 4*a* and 5*a*, metal bus electrodes 4*b* and 5*b* and light blocking layers 7 formed on front glass substrate 3. Second dielectric layer 82 is formed on first dielectric layer 81. In addition, protective layer 9 is formed on second dielectric layer 82. Protective layer 9 includes base film 91 formed on dielectric layer 8 and aggregated particles 92 attached to base film 91.

Next, a method of manufacturing a PDP is described. Firstly, scan electrodes 4, sustain electrodes 5 and light blocking layers 7 are formed on front glass substrate 3. Transparent electrodes 4*a* and 5*a* and metal bus electrodes 4*b* and 5*b* are formed by patterning by, for example, a photolithography method. Transparent electrodes 4*a* and 5*a* are formed by, for example, a thin film process. Metal bus electrodes 4*b* and 5*b* are formed by firing a paste containing a silver (Ag) material at a desired temperature so as to be solidified. Furthermore, light blocking layer 7 is similarly formed by a method of screen printing of paste containing a black pigment, or a method of forming a black pigment over the entire surface of the glass substrate, then carrying out patterning by a photolithography method, and firing thereof.

Next, a dielectric paste is coated on front glass substrate 3 by, for example, a die coating method so as to cover scan electrodes 4, sustain electrodes 5 and light blocking layer 7, thus forming a dielectric paste layer (dielectric material layer). After dielectric paste is coated, it is stood still for a predetermined time. Thus, the surface of the coated dielectric paste is leveled and flattened. Thereafter, the dielectric paste layer is fired and solidified, thereby forming dielectric layer 8 that covers scan electrode 4, sustain electrode 5 and light blocking layer 7. Note here that the dielectric paste is a coating material including a dielectric material such as glass powder, a binder and a solvent. Next, protective layer 9 made of magnesium oxide (MgO) is formed on dielectric layer 8 by vacuum evaporation method. From the above-mentioned steps, predetermined components (scan electrode 4, sustain electrode 5, light blocking layer 7, dielectric layer 8, and protective layer 9) are formed on front glass substrate 3. Thus, front panel 2 is completed.

On the other hand, rear panel 10 is formed as follows. Firstly, a material layer as components for address electrode 12 is formed on rear glass substrate 11 by, for example, a method of screen printing a paste including a silver (Ag) material, or a method of forming a metal film over the entire surface and then patterning it by a photolithography method. Then, the material layer is fired at a predetermined temperature. Thus, address electrode 12 is formed. Next, a dielectric paste is coated so as to cover address electrodes 12 by, for example, a die coating method on rear glass substrate 11 on which address electrode 12 is formed. Thus, a dielectric paste layer is formed. Thereafter, by firing the dielectric paste layer, base dielectric layer 13 is formed. Note here that a dielectric paste is a coating material including a dielectric material such as glass powder, a binder, and a solvent.

Next, by coating a barrier rib formation paste containing materials for barrier ribs on base dielectric layer 13 and patterning it into a predetermined shape, a barrier rib material layer is formed. Then, the barrier rib material layer is fired to form barrier ribs 14. Herein, a method of patterning the barrier rib formation paste coated on base dielectric layer 13 may include a photolithography method and a sand-blast method. Next, a phosphor paste containing a phosphor material is coated on base dielectric layer 13 between neighboring barrier ribs 14 and on the side surfaces of barrier ribs 14 and fired. Thereby, phosphor layer 15 is formed. With the above-mentioned steps, rear panel 10 having predetermined component members on rear glass substrate 11 is completed.

In this way, front panel 2 and rear panel 10, which include predetermined component members, are disposed facing each other so that scan electrodes 4 and address electrodes 12 are disposed orthogonal to each other, and sealed together at the peripheries thereof with a glass frit. Discharge gas including, for example, Ne and Xe, is filled in discharge space 16. Thus, PDP 1 is completed.

Herein, first dielectric layer 81 and second dielectric layer 82 constituting dielectric layer 8 of front panel 2 are described in detail. A dielectric material of first dielectric layer 81 includes the following material compositions: 20 wt. % to 40 wt. % of bismuth oxide ($Bi_2O_3$); 0.5 wt. % to 12 wt. % of at least one selected from calcium oxide (CaO), strontium oxide (SrO) and barium oxide (BaO); and 0.1 wt. % to 7 wt. % of at least one selected from molybdenum oxide ($MoO_3$), tungsten oxide ($WO_3$), cerium oxide ($CeO_2$), and manganese oxide ($MnO_2$).

Instead of molybdenum oxide ($MoO_3$), tungsten oxide ($WO_3$), cerium oxide ($CeO_2$) and manganese oxide ($MnO_2$), 0.1 wt. % to 7 wt. % of at least one selected from copper oxide (CuO), chromium oxide ($Cr_2O_3$), cobalt oxide ($Co_2O_3$), vanadium oxide ($V_2O_7$) and antimony oxide ($Sb_2O_3$) may be included.

Furthermore, as components other than the components mentioned above, a material composition that does not include a lead component, for example, 0 wt. % to 40 wt. % of zinc oxide (ZnO), 0 wt. % to 35 wt. % of boron oxide ($B_2O_3$), 0 wt. % to 15 wt. % of silicon oxide ($SiO_2$) and 0 wt. % to 10 wt. % of aluminum oxide ($Al_2O_3$) may be contained. The contents of such material compositions are not particularly limited, and the contents of material compositions may be around the range of that in conventional technologies.

The dielectric materials including these composition components are ground to have an average particle diameter of 0.5 μm to 2.5 μm by using a wet jet mill or a ball mill to form dielectric material powder. Then, 55 wt % to 70 wt % of the dielectric material powders and 30 wt % to 45 wt % of binder components are well kneaded by using three rolls to form a paste for the first dielectric layer to be used in die coating or printing.

The binder component is ethylcellulose, or terpineol containing 1 wt % to 20 wt % of acrylic resin, or butyl carbitol acetate. Furthermore, in the paste, if necessary, at least one of dioctyl phthalate, dibutyl phthalate, triphenyl phosphate and tributyl phosphate may be added as a plasticizer; and at least one of glycerol monooleate, sorbitan sesquioleate, Homogenol (Kao Corporation), an alkylallyl phosphate, and the like may be added as a dispersing agent, so that the printing property may be improved.

Then, this first dielectric layer paste is printed on front glass substrate 3 by a die coating method or a screen printing method so as to cover display electrodes 6 and dried, followed by firing at a temperature of 575° C. to 590° C., that is, a slightly higher temperature than the softening point of the dielectric material.

Next, second dielectric layer 82 is described. A dielectric material of second dielectric layer 82 includes the following material compositions: 11 wt. % to 20 wt. % of bismuth oxide ($Bi_2O_3$); furthermore, 1.6 wt. % to 21 wt. % of at least one selected from calcium oxide (CaO), strontium oxide (SrO), and barium oxide (BaO); and 0.1 wt. % to 7 wt. % of at least one selected from molybdenum oxide ($MoO_3$), tungsten oxide ($WO_3$), and cerium oxide ($CeO_2$).

Instead of molybdenum oxide ($MoO_3$), tungsten oxide ($WO_3$) and cerium oxide ($CeO_2$), 0.1 wt. % to 7 wt. % of at least one selected from copper oxide (CuO), chromium oxide ($Cr_2O_3$), cobalt oxide ($Co_2O_3$), vanadium oxide ($V_2O_7$), antimony oxide ($Sb_2O_3$) and manganese oxide ($MnO_2$) may be included.

Furthermore, as components other than the above-mentioned components, a material composition that does not include a lead component, for example, 0 wt. % to 40 wt. % of zinc oxide (ZnO), 0 wt. % to 35 wt. % of boron oxide ($B_2O_3$), 0 wt. % to 15 wt. % of silicon oxide ($SiO_2$) and 0 wt. % to 10 wt. % of aluminum oxide ($Al_2O_3$) may be contained. The contents of such material compositions are not particularly limited, and the contents of material compositions may be around the range of that in conventional technologies.

The dielectric materials including these composition components are ground to have an average particle diameter of 0.5 μm to 2.5 μm by using a wet jet mill or a ball mill to form dielectric material powder. Then, 55 wt % to 70 wt % of the dielectric material powders and 30 wt % to 45 wt % of binder component are well kneaded by using three rolls to form a paste for a second dielectric layer to be used in die coating or printing. The binder component is ethylcellulose, or terpineol containing 1 wt % to 20 wt % of acrylic resin, or butyl carbitol acetate. Furthermore, in the paste, if necessary, dioctyl phthalate, dibutyl phthalate, triphenyl phosphate and tributyl phosphate may be added as a plasticizer, glycerol monooleate, sorbitan sesquioleate, Homogenol (Kao Corporation), an alkylallyl phosphate, and the like, may be added as a dispersing agent, so that the printing property may be improved.

Next, this second dielectric layer paste is printed on first dielectric layer 81 by a screen printing method or a die coating method and dried, followed by firing at a temperature of 550° C. to 590° C., that is, a slightly higher temperature than the softening point of the dielectric material.

Note here that it is preferable that the film thickness of dielectric layer 8 in total of first dielectric layer 81 and second dielectric layer 82 is not more than 41 μm in order to secure the visible light transmittance. The content of bismuth oxide ($Bi_2O_3$) of first dielectric layer 81 is set to be 20 wt % to 40 wt %, which is higher than the content of bismuth oxide in second dielectric layer 82, in order to suppress the reaction between metal bus electrodes **4*b* and 5*b* and silver (Ag). Therefore, since the visible light transmittance of first dielectric layer 81 becomes lower than that of second dielectric layer 82, the film thickness of first dielectric layer 81 is set to be thinner than that of second dielectric layer 82**.

It is not preferable that the content of bismuth oxide ($Bi_2O_3$) is not more than 11 wt % in second dielectric layer 82 because bubbles tend to be generated in second dielectric layer 82 although coloring does not easily occur. Furthermore, it is not preferable that the content is more than 40 wt % for the purpose of increasing the transmittance because coloring tends to occur.

As the film thickness of dielectric layer 8 is smaller, the effect of improving the panel brightness and reducing the discharge voltage is more remarkable. Therefore, it is desirable that the film thickness is set to be as small as possible within a range in which withstand voltage is not reduced. From the viewpoint of this, in the exemplary embodiment of the present invention, the film thickness of dielectric layer 8 is set to be not more than 41 μm, that of first dielectric layer 81 is set to be 5 μm to 15 μm, and that of second dielectric layer 82 is set to be 20 μm to 36 μm.

In the thus manufactured PDP, it is confirmed that even when a silver (Ag) material is used for display electrode 6, less coloring phenomenon (yellowing) of front glass substrate 3 occurs, and that dielectric layer 8 in which less bubbles are generated and which is excellent in withstand voltage performance can be realized.

Next, in the PDP in accordance with the exemplary embodiment of the present invention, the reason why these dielectric materials suppress the generation of yellowing or bubbles in first dielectric layer 81 is considered. That is to say, it is known that by adding molybdenum oxide ($MoO_3$) or tungsten oxide ($WO_3$) to dielectric glass containing bismuth oxide ($Bi_2O_3$), compounds such as $Ag_2MoO_4$, $Ag_2Mo_2O_7$, $Ag_2Mo_4O_{13}$, $Ag_2WO_4$, $Ag_2W_2O_7$, and $Ag_2W_4O_{13}$ are easily generated at such a low temperature as not higher than 580° C. In this exemplary embodiment of the present invention, since the firing temperature of dielectric layer 8 is 550° C. to 590° C., silver ions ($Ag^+$) dispersing in dielectric layer 8 during firing are reacted with molybdenum oxide ($MoO_3$), tungsten oxide ($WO_3$), cerium oxide ($CeO_2$), and manganese oxide ($MnO_2$) in dielectric layer 8 so as to generate a stable compound and be stabilized. That is to say, since silver ions ($Ag^+$) are stabilized without being reduced, they do not aggregate to form a colloid. Therefore, silver ions ($Ag^+$) are stabilized, thereby reducing the generation of oxygen accompanying the formation of colloid of silver (Ag). Therefore, the generation of bubbles in dielectric layer 8 is reduced.

On the other hand, in order to make these effects be effective, it is preferable that the contents of molybdenum oxide ($MoO_3$), tungsten oxide ($WO_3$), cerium oxide ($CeO_2$), and manganese oxide ($MnO_2$) in the dielectric glass containing bismuth oxide ($Bi_2O_3$) is not less than 0.1 wt. %. It is more preferable that the content is not less than 0.1 wt. % and not more than 7 wt. %. In particular, it is not preferable that the content is less than 0.1 wt. % because the effect of suppressing yellowing is reduced. Furthermore, it is not preferable that the content is more than 7 wt. % because coloring occurs in the glass.

That is to say, in dielectric layer 8 of PDP in accordance with the exemplary embodiment of the present invention, the generation of yellowing phenomenon and bubbles are suppressed in first dielectric layer 81 that is brought into contact with metal bus electrodes 4*b* and 5*b* made of silver (Ag) material, and high light transmittance is realized by second dielectric layer 82 formed on first dielectric layer 81. As a result, it is possible to realize a PDP in which dielectric layer 8 as a whole has extremely reduced generation of bubbles or yellowing and has high transmittance.

Next, a configuration and a manufacturing method of a protective layer that is the feature of the present invention, are described.

Figure 3:
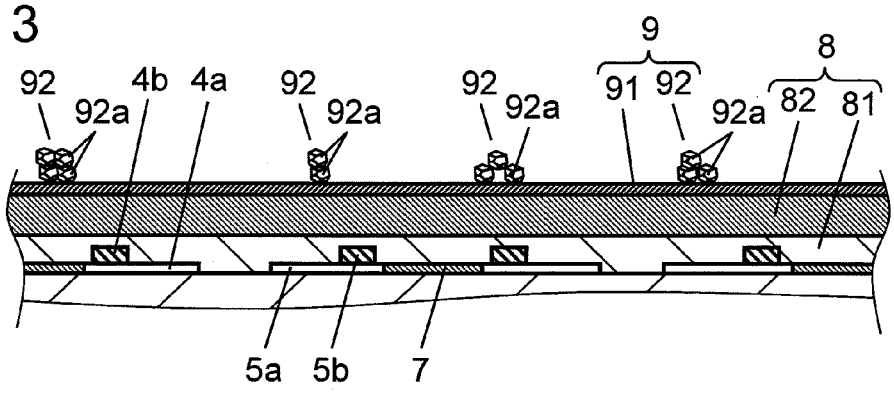
FIG. 3 is an enlarged view illustrating a protective layer part of the PDP.

In a PDP of the present invention, as shown in FIG. 3, protective layer 9 includes base film 91 and aggregated particles 92. Base film 91, which is made of MgO containing Al as an impurity, is formed on dielectric layer 8. Aggregated particles 92 made of a plurality of crystal particles 92*a* of MgO as metal oxide are discretely scattered on base film 91 so that a plurality of aggregated particles 92 are distributed over the entire surface substantially uniformly.

Figure 4:
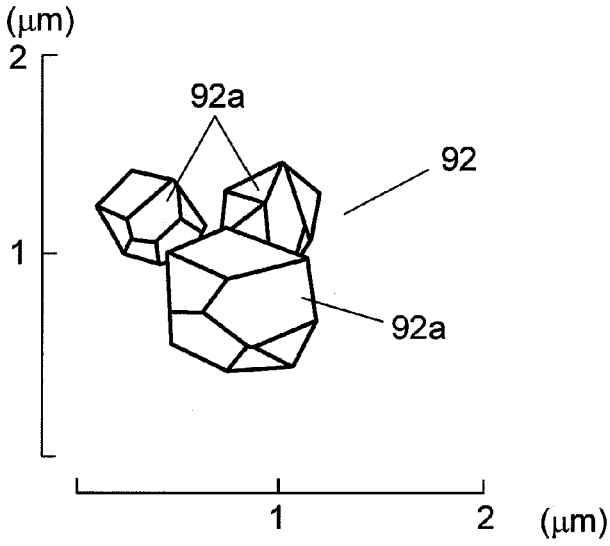
FIG. 4 is an enlarged view illustrating aggregated particles in the protective layer of the PDP.

Herein, aggregated particle 92 is a state in which crystal particles 92*a* having a predetermined primary particle diameter are aggregated or necked as shown in FIG. 4. In aggregated particle 92, crystal particles 92*a* are not bonded to each other as a solid with a large bonding strength but a plurality of primary particles are combined as an assembly structure by static electricity, Van der Waals force, or the like. That is to say, a part or all of crystal particles 92*a* are combined by an external stimulation such as ultrasonic wave to a degree that they are in a state of primary particles. The particle diameter of aggregated particles 92 is about 1 μm. It is desirable that crystal particle 92*a* has a shape of polyhedron having seven faces or more, for example, truncated octahedron and dodecahedron.

Furthermore, the primary particle diameter of crystal particle 92*a* of MgO can be controlled by the production condition of crystal particle 92*a*. For example, when crystal particle 92*a* of MgO is produced by firing an MgO precursor such as magnesium carbonate or magnesium hydroxide, the particle diameter can be controlled by controlling the firing temperature or firing atmosphere. In general, the firing temperature can be selected in the range from about 700° C. to about 1500° C. When the firing temperature is set to be relatively high temperature such as 1000° C. or more, the primary particle diameter can be controlled to about 0.3 to 2 μm. Furthermore, when crystal particle 92*a* is obtained by heating an MgO precursor, it is possible to obtain aggregated particles 92 in which a plurality of primary particles are combined by aggregation or a phenomenon called necking during production process.

Next, results of experiments carried out for confirming the effect of the PDP having the protective layer in accordance with the present invention is described.

Figure 5:
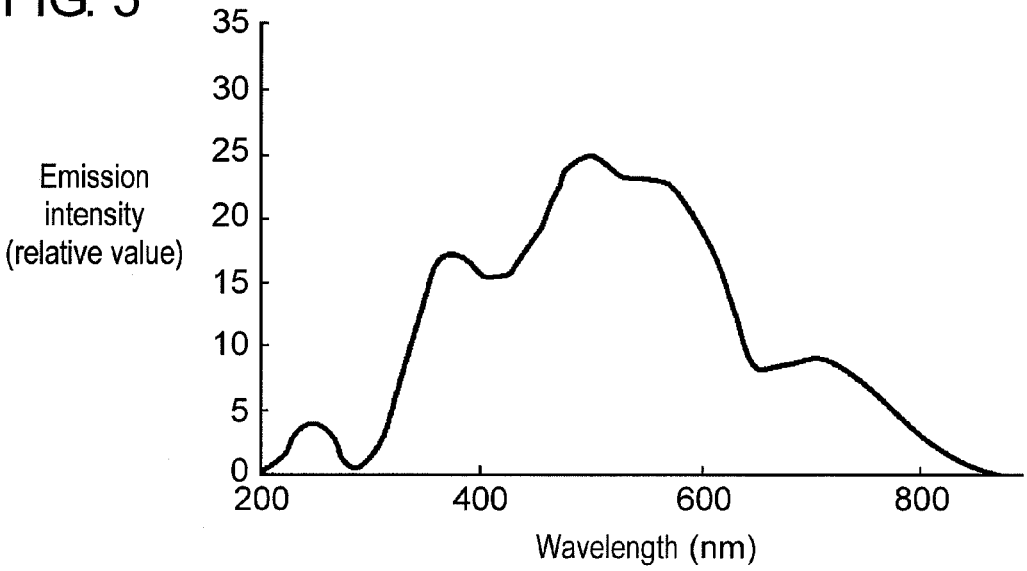
FIG. 5 is a graph showing a measurement result of cathode luminescence of a crystal particle.

Firstly, PDPs having protective layers having different configurations are made as trial products. Trial product 1 is a PDP including only a protective layer made of MgO. Trial product 2 is a PDP including a protective layer made of MgO doped with impurities such as Al and Si. Trial product 3 is a PDP including only primary particles of metal oxide crystal particles scattered and attached on a base film made of MgO. Trial product 4 is a product of the present invention and is a PDP in which aggregated particles obtained by aggregating crystal particles are attached on a base film made of MgO doped with Al as impurities so that the aggregated particles are distributed over the entire surface of the base film substantially uniformly as mentioned above. Note here that in trial products 3 and 4, as the metal oxide, single crystal particles of MgO are used. Furthermore, in trial product 4 according to the present invention, when the cathode luminescence of crystal particles attached to the base film is measured, it has a property of the emission intensity vs. wavelength shown in FIG. 5. The emission intensity is shown by relative values.

PDPs having these four kinds of configurations of protective layers are examined for the electron emission performance and the electric charge retention performance.

Note here that as the larger the electron emission performance is, the larger the amount of emitted electrons is. The electron emission performance is expressed by the initial electron emission amount determined by the surface state by discharge, kinds of gases and the state thereof. The initial electron emission amount can be measured by a method of measuring the amount of electron current emitted from the surface after the surface is irradiated with ions or electron beams. However, it is difficult to evaluate the front panel surface in a nondestructive way. Therefore, as described in Japanese Patent Unexamined Publication No. 2007-48733, the value called a statistical lag time among lag times at the time of discharge, which is an index showing the discharging tendency, is measured. By integrating the inverse number of the value, the value becomes a numeric value linearly corresponding to the initial electron emission amount. Thus, herein, this value is used so as to evaluate the electron emission amount. This lag time at the time of discharge means a time of discharge delay in which discharge is delayed from the time of the rising of pulse. The main factor of this discharge delay is thought to be that the initial electron functioning as a trigger is not easily emitted from a protective layer surface to discharge space when discharge is started.

Furthermore, the charge retention performance uses, as the index thereof, a value of a voltage applied to a scan electrode (hereinafter, referred to as "Vscn lighting voltage") that is necessary to suppress the phenomenon of releasing electric charge when the PDP is manufactured. That is to say, it is shown that when Vscn lighting voltage is lower, the charge retention performance is higher. This is advantageous because driving at a low voltage is possible in designing of a panel of a PDP. That is to say, as a power supply or electrical components of a PDP, components having a withstand voltage and a small capacity can be used. In current products, as semiconductor switching elements such as MOSFET for applying a scanning voltage to a panel sequentially, an element having a withstand voltage of about 150 V is used. For the Vscn lighting voltage, it is desirable that the voltage is suppressed to not more than 120 V with considering the fluctuation due to temperatures.

Figure 6:
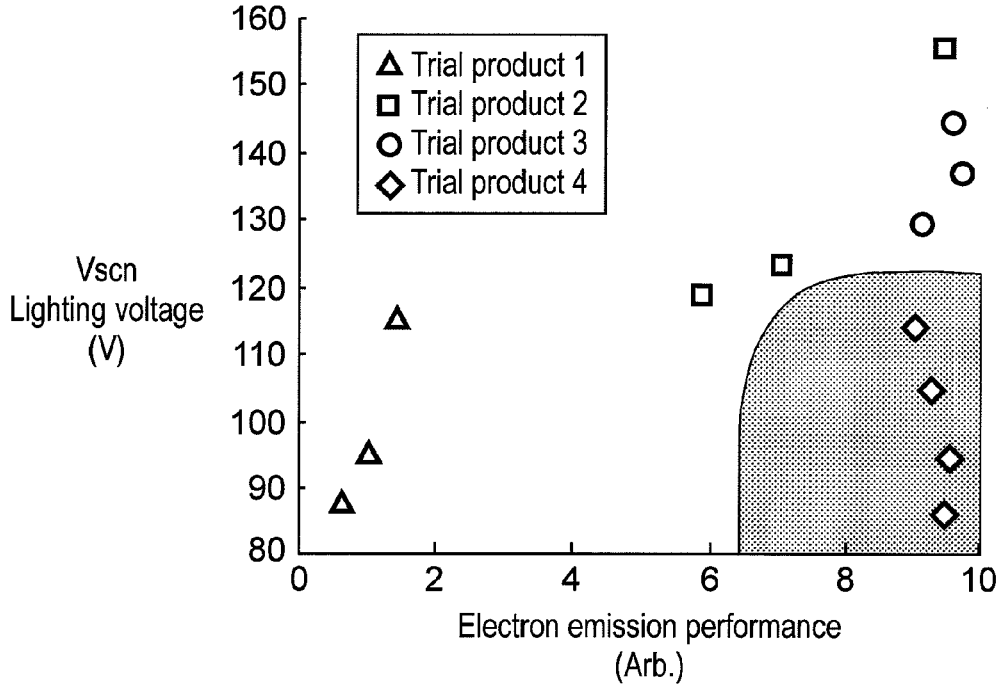
FIG. 6 is a graph showing an investigation result of electron emission performance in a PDP and a Vscn lighting voltage in the results of experiments carried out for illustrating the effect by the present invention.

Results of examination of the electron emission performance and charge retention performance are shown in FIG. 6. As is apparent from FIG. 6, trial product 4 of the present invention, in which aggregated particles obtained by aggregating single crystal particles of MgO are scattered on the base film made of MgO containing Al so that the aggregated particles are distributed over the entire surface substantially uniformly, has excellent properties: the charge retention performance that a Vscn lighting voltage can be set to not more than 120 V and the electron emission performance of not less than 6. In a protective layer of a PDP in which the number of scanning lines tends to increase with the high definition and the cell size tends to be smaller, both the electron emission performance and the charge retention performance can be satisfied.

Next, the particle diameter of crystal particles used in the protective layer of a PDP in the present invention is described. Note here that in the below-mentioned description, the particle diameter denotes an average particle diameter, and the average particle diameter denotes a volume cumulative mean diameter (D50).

Figure 7:
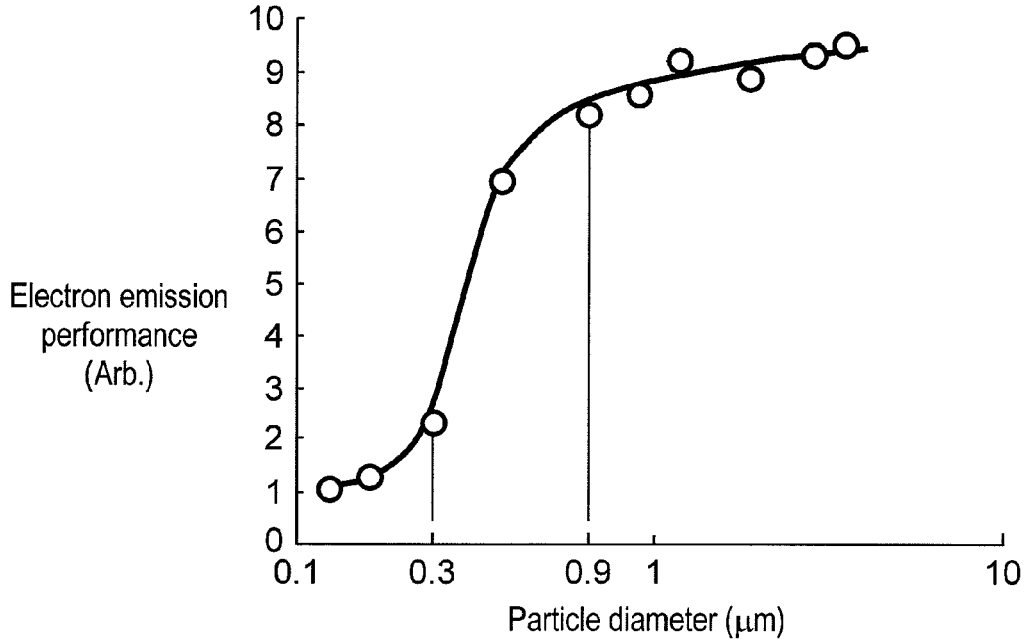
FIG. 7 is a graph showing a relation between a particle diameter of a crystal particle and the electron emission performance.

FIG. 7 shows a result of an experiment that the electron emission performance is examined by changing the particle diameter of the crystal particle of MgO in the trial product 4 of the present invention described in the above-mentioned FIG. 6. In FIG. 7, the particle diameter of the crystal particle of MgO is measured by SEM observation of the crystal particles.

As shown in FIG. 7, it is shown that when the particle diameter is reduced to about 0.3 μm, the electron emission performance is reduced, and that when the particle diameter is substantially not less than 0.9 μm, high electron emission performance can be obtained.

In order to increase the number of emitted electrons in the discharge cell, it is desirable that the number of crystal particles per unit area on the base film is increased. According to the experiment by the present inventors, when crystal particles exist in a portion corresponding to the top portion of the barrier rib of the rear panel that is in close contact with the protective layer of the front panel, the top portion of the barrier rib may be damaged. As a result, the material may be put on a phosphor, causing a phenomenon that the corresponding cell is not normally lighted. The phenomenon that a barrier rib is damaged can be suppressed if crystal particles do not exist on the top portion corresponding to the barrier rib. Therefore, when the number of crystal particles to be attached is increased, the rate of occurrence of the damage of the barrier ribs is increased.

Figure 8:
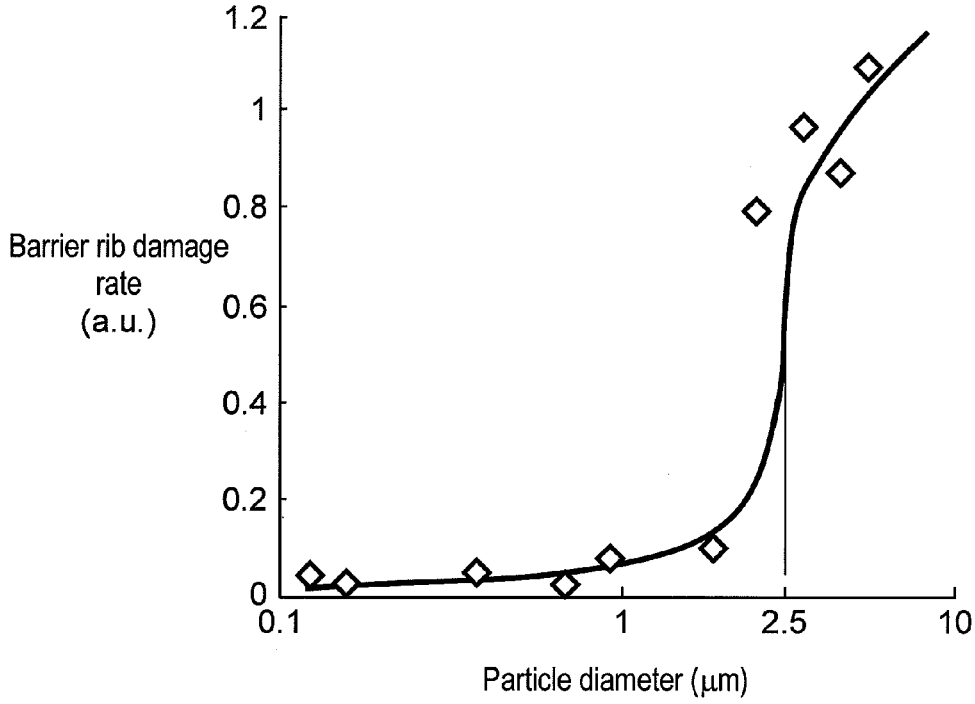
FIG. 8 is a graph showing a relation between a particle diameter of the crystal particle and the rate of occurrence of damage in a barrier rib.

FIG. 8 is a graph showing the results of experiments of examining the relation between the particle diameter and the damage of the barrier ribs when the same number of crystal particles having different particle diameters are scattered in a unit area in trial product 4 of the present invention described in FIG. 6.

As is apparent from FIG. 8, it is shown that when the diameter of crystal particle is increased to about 2.5 μm, the probability of the damage of the barrier ribs rapidly rises but that when the diameter of crystal particle is less than 2.5 μm, the probability of the damage of the barrier rib can be suppressed to relatively small.

Based on the above-mentioned results, it is thought to be desirable to use crystal particles having a particle diameter of not less than 0.9 μm and not more than 2.5 μm in the protective layer of the PDP of the present invention. However, in actual mass production of PDPs, variation in manufacturing crystal particles or variation in forming protective layers need to be considered.

Figure 9:
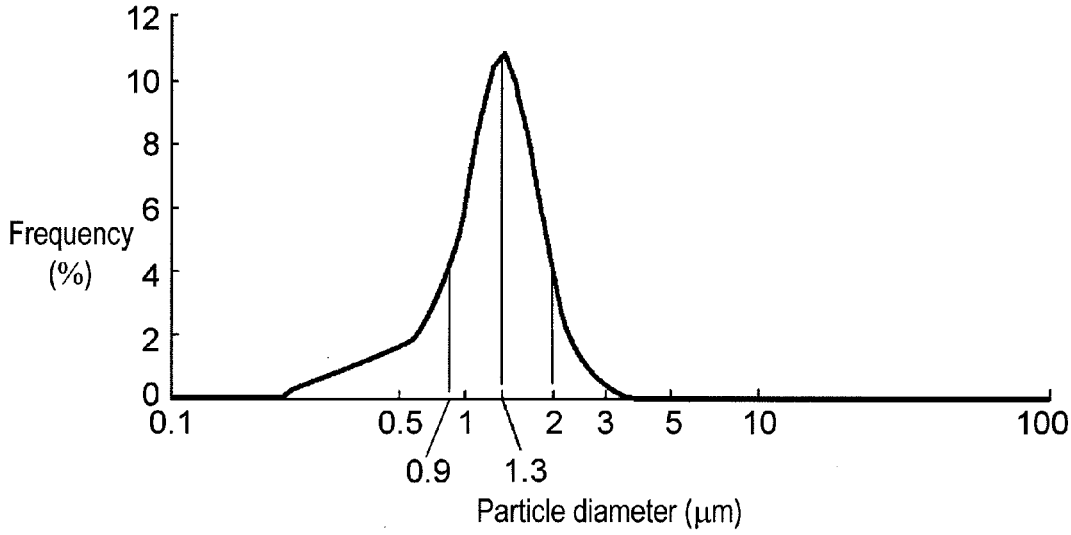
FIG. 9 is a graph showing an example of the particle size distribution of aggregated particles in a PDP in accordance with the present invention.

In order to consider the factors such a variation in manufacturing, experiments using crystal particles having different particle size distributions are carried out. FIG. 9 is a graph showing one example of the particle size distributions of the aggregated particles. The frequency (%) shown in the ordinate is a rate (%) of the amount of aggregated particles existing in each range of particle diameter shown in the abscissas with respect to the entire part. As a result of the experiment, as shown in FIG. 9, when aggregated particles having an average particle diameter of not less than 0.9 μm and not more than 2 μm are used, the above-mentioned effect of the present invention can be obtained stably.

As mentioned above, in a PDP including the protective layer of the present invention, a PDP including a protective layer having the charge retention performance of not less than 6 and the electron emission performance that Vscn lighting voltage is not more than 120 V can be obtained. That is to say, in a protective layer of a PDP in which the number of scanning lines tends to increase with the high definition and the cell size tends to be smaller, both the electron emission performance and the charge retention performance can be satisfied. Thus, a PDP having a high definition and high brightness display performance, and low electric power consumption can be realized.

Next, manufacturing step for forming a protective layer in a PDP of the present invention is described with reference to FIG. 10.

Figure 10:
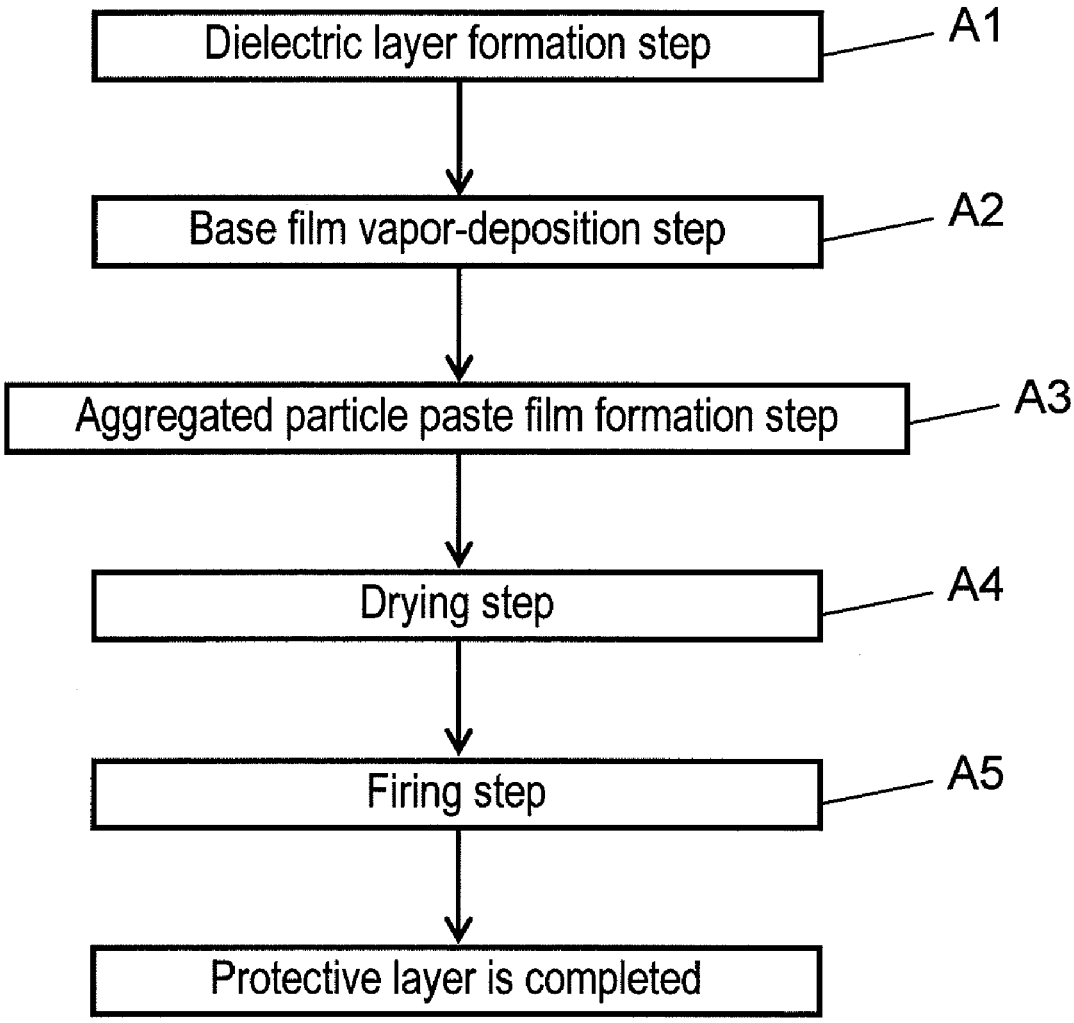
FIG. 10 is a chart showing steps of forming a protective layer in a method of manufacturing a PDP in the present invention.

As shown in FIG. 10, dielectric layer formation step A1 of forming dielectric layer 8 having a laminated structure of first dielectric layer 81 and second dielectric layer 82 is carried out. Thereafter, in the following base film vapor-deposition step A2, a base film made of MgO is formed on second dielectric layer 82 of dielectric layer 8 by a vacuum deposition method using a sintered body of MgO containing aluminum (Al) as a raw material.

Thereafter, a step of discretely attaching a plurality of aggregated particles to the not-fired base film formed in base film vapor deposition step A2 is carried out.

In this step, firstly, an aggregated particle paste obtained by mixing aggregated particles 92 having a predetermined particle size distribution together with a resin component in a solvent is prepared. Then, in aggregated particle paste film formation step A3, the aggregated particle paste is coated on the not-fired base film by printing method such as a screen printing method so as to form an aggregated particle paste film. An example of the method of coating the aggregated particle paste to a not-fired base film so as to form an aggregated particle paste film may include a spray method, a spin-coat method, a die coating method, a slit coat method, and the like, in addition to the screen printing method, After this aggregated particle paste film is formed, drying step A4 of drying the aggregated particle paste film is carried out.

Thereafter, the not-fired base film formed in base film vapor deposition step A2 and the aggregated particle paste film formed in aggregated particle paste film formation step A3 and subjected to drying step A4 are fired simultaneously at a temperature of several hundred degrees in firing step A5. In firing step A5, the solvent or resin components remaining in the aggregated particle paste film are removed, and thereby protective layer 92 in which a plurality of aggregated particles 9 are attached to base film 91 can be formed.

According to this method, a plurality of aggregated particles 92 can be attached to base film 91 so that they are distributed over the entire surface of base film 91 substantially uniformly.

In addition to such methods, a method of directly spraying particle group together with gas without using a solvent or a scattering method by simply using gravity may be used.

In the above description, as a protective layer, MgO is used as an example. However, performance which the base requires is high sputter resistance performance for protecting a dielectric layer from ion bombardment. In most of conventional PDPs, a protective layer containing MgO as a main component is formed in order to obtain predetermined level or more of electron emission performance and sputter resistance performance. However, for a configuration in which the electron emission performance is dominantly controlled by metal oxide single crystal particles, MgO is not necessarily used. Other materials such as $Al_2O_3$ having an excellent shock resistance may be used.

In this exemplary embodiment, as single crystal particles, MgO particles are used. However, since the same effect can be obtained even when other single crystal particles of oxide of metal such as Sr, Ca, Ba, and Al having high electron emission performance similar to MgO are used, the kinds of particles are not limited to MgO.

As mentioned above, the present invention is useful in realizing a PDP having high definition and high brightness display performance and low electric power consumption.

The invention claimed is:

1. A plasma display panel, comprising:

a front panel including a substrate, a display electrode formed on the substrate, a dielectric layer formed so as to cover the display electrode, and a protective layer formed on the dielectric layer; and a rear panel disposed facing the front panel so that a discharge space is formed, and including an address electrode formed in a direction intersecting the display electrode, and a barrier rib for partitioning the discharge space, wherein the protective layer includes a base film and a plurality of aggregated particles, the base film being formed on the dielectric layer and each of the plurality of aggregated particles being distributed uniformly over the entire surface of the base film, each aggregated particle including a plurality of crystal particles of metal oxide of a predetermined particle diameter and shape that are aggregated together by forces between the particles but not by adhesive bonding, each aggregated particle comprises a plurality of the crystal particles piled up on each other to form an aggregated lumped formation and the base film is made of MgO containing Al.

2. The plasma display panel of claim 1, wherein the aggregated particles have an average particle diameter of not less than 0.9 μm and not more than 2 μm.

3. The plasma display panel of claim 1, wherein the plurality of crystal particles of metal oxide making up each of the aggregated particle are aggregated together by an external stimulus.

4. The plasma display panel of claim 3, wherein the external stimulus is provided by an ultrasonic wave or static electricity.

5. The plasma display panel of claim 2, wherein the aggregated particles each have a shape of a polyhedron.

* * * * *